US007223077B2

(12) United States Patent
Nishiyama et al.

(10) Patent No.: US 7,223,077 B2
(45) Date of Patent: May 29, 2007

(54) STRUCTURE FOR CONNECTING COMPRESSOR WHEEL AND SHAFT

(75) Inventors: Toshihiko Nishiyama, Oyama (JP); Hiroshi Sugito, Oyama (JP); Takahisa Iino, Oyama (JP); Tetsuaki Ogawa, Oyama (JP); Hiroyasu Satou, Oyama (JP)

(73) Assignee: Komatsu Ltd., Tokyo (JP)

( * ) Notice: Subject to any disclaimer, the term of this patent is extended or adjusted under 35 U.S.C. 154(b) by 298 days.

(21) Appl. No.: 11/052,112

(22) Filed: Feb. 8, 2005

(65) Prior Publication Data

US 2005/0175465 A1 Aug. 11, 2005

(30) Foreign Application Priority Data

Feb. 10, 2004 (JP) ..... 2004-033259

(51) Int. Cl.
*F04D 29/20* (2006.01)

(52) U.S. Cl. ..... 416/204 A; 416/244 A

(58) Field of Classification Search ..... 416/244 A, 416/204 A; 403/286, 293, 296
See application file for complete search history.

(56) References Cited

U.S. PATENT DOCUMENTS 347,397 A * 8/1886 Throckmorton et al. .... 403/286
3,914,067 A 10/1975 Leto
3,961,867 A * 6/1976 Woollenweber ..... 416/244 A
4,499,646 A 2/1985 Allor et al.

FOREIGN PATENT DOCUMENTS

| | | |
|---|---|---|
| GB | 1 292 848 | 10/1972 |
| GB | 1 403 864 | 4/1976 |
| GB | 2 402 991 | 12/2004 |
| JP | 5-504178 | 5/1991 |

* cited by examiner

*Primary Examiner*—Richard A. Edgar
(74) *Attorney, Agent, or Firm*—Posz Law Group, PLC; R. Eugene Varndell, Jr.

(57) ABSTRACT

It is an object of the invention to provide a structure for connecting a compressor wheel and a shaft, which structure is not easily broken when rotated at high speed. A male screw is provided on an outer surface of a projection formed on the center of a rear of the compressor wheel, and a male screw is provided on a shaft. The compressor wheel and the shaft are connected with each other by a sleeve having female screws provided at each end thereof. An engagement portion is provided between the compressor wheel and the shaft.

10 Claims, 5 Drawing Sheets

STRUCTURE FOR CONNECTING COMPRESSOR WHEEL AND SHAFT

BACKGROUND OF THE INVENTION

1. Field of the Invention

The present invention relates to a structure for connecting a compressor wheel and a shaft.

2. Description of the Related Art

As means for compressing air to increase the amount of intake air to an engine, a compressor of a turbo machine which rotates a turbine wheel and a shaft by utilizing energy of exhaust gas and drives a centrifugal type compressor wheel connected with the shaft is known as a turbo charger.

FIG. 11 is a sectional side view of a turbo charger 111 according to the related prior art. The turbo charger 111 includes an exhaust-side unit 112 for gaining rotational energy from the exhaust gas of an engine and an intake-side unit 113 for compressing air by the rotational energy and supplying the compressed air to the engine.

A turbine wheel 114 receives energy from the exhaust gas flowing thereto from an exhaust inflow passage 119 and rotates by the energy. A centrifugal type compressor wheel 116 for compressing air via a shaft 123 is fitted to the shaft 123 on a side opposite to the turbine wheel 114, i.e., the tip of the shaft 123.

A fitting hole 125 penetrates through a center of the compressor wheel 116. The shaft 123 is fitted into the fitting hole 125 by slight clearance fit or close fit. The compressor wheel 116 is fixed to the shaft 123 by fastening a fitting nut 126 to a male screw 140 formed at the tip of the shaft 123.

FIG. 12 is a sectional side view of the compressor wheel 116 according to the related art. A main body 129 of the compressor wheel 116 includes an inlet-side disk portion 129A and a back-side disk portion 129B. A plurality of vanes 118 are arranged outside the main body 129, and the fitting hole 125 penetrates through the center of the main body 129.

The compressor wheel 116 is produced from a casting such as an aluminum alloy or other material so as to be light-weight. Since the rotating speed of the compressor wheel 116 reaches values as high as tens of thousands rpm, extremely high tensile stress is applied on the compressor wheel 116 in its radial direction due to centrifugal force generated by the high rotating speed and thus the compressor wheel 116 may be broken in some cases.

It is known that the breakage of this type is likely to develop particularly in the inner wall of the fitting hole 125 starting therefrom. More specifically, it has been clarified that the breakage of the inner wall of the fitting hole 125 formed on the compressor wheel 116 occurs particularly in the vicinity of a maximum outer diameter 130 where the outer diameter of the compressor wheel 116 reaches a maximum in an axial direction of a rotational axis of the compressor wheel 116.

In order to solve this problem, a technology described in Patent Reference No. JP-T-5-504178 (the term "JP-T" as used herein means a published Japanese translation of a PCT patent application. pp. 3 to 5, FIGS. 1 and 2), for example, is utilized.

FIG. 13 is a cross-sectional view of a compressor wheel 216 according to the patent reference. A fitting hole penetrating through the compressor wheel 216 is not provided but a fitting opening 242 having a female screw is formed at a lower region of the compressor wheel 216. A male screw is provided at a tip 254 of a shaft 223. The shaft 223 and the compressor wheel 216 are coupled with each other by screwing the tip 254 into the fitting opening 242.

However, since the fitting opening is also provided in the vicinity of the maximum outer diameter where the outer diameter of the compressor wheel reaches a maximum in the axial direction of the rotational axis of the compressor wheel in the related art shown in the patent reference, there is a possibility of breakage starting from a region around the maximum outer diameter when the rotating speed is increased.

Particularly when an engine equipped with the turbo charger using the compressor wheel is employed in working machines such as construction machines, a high load condition such as a loading operation (a high rotating speed of the engine) and an almost no load condition (a low rotating speed of the engine) are alternately repeated at short intervals.

As a result, the stress amplitude applied to the compressor wheel increases and the breakage is more likely to occur.

Recently, a technology called "EGR" (Exhaust Gas recirculation) has been executed as measures for the reduction of nitrogen oxides (NOx) contained in exhaust gas of Diesel engines. In this method, a part of exhaust gas discharged from an engine is returned to an intake system of the engine for re-circulation.

For accomplishing EGR, it is necessary to achieve a higher pressure ratio of the turbo charger so as to secure combustion air from a capacity of fresh air within a cylinder which capacity is reduced by the amount of the re-circulated exhaust gas, and thus the rotating speed at which the compressor wheel is rotated needs to be increased. However, the related art is not sufficient to overcome the above problem and it is thus desired to develop a compressor wheel having higher durability.

SUMMARY OF THE INVENTION

In view of the problems described above, it is an object of the invention to provide a structure for connecting a compressor wheel and a shaft, which is not easily broken at high rotating speed.

In order to achieve the above object, a connecting structure according to the present invention includes a compressor wheel, a shaft and a sleeve, wherein: the compressor wheel has a male screw formed on an outer surface of a projection provided at the center of a rear surface of the compressor wheel; the shaft has a male screw provided at one end thereof; the sleeve has a female screw provided at each end thereof and connects the compressor wheel and the shaft; and an engagement portion is provided between the compressor wheel and the shaft.

An engagement portion may be provided between the compressor wheel and the sleeve.

An engagement portion may be provided between the shaft and the sleeve.

An engagement portion engaging with the sleeve may be provided on each of the compressor wheel and the shaft.

A plate made from material having higher strength than the material of the compressor wheel may be provided, and the compressor wheel and the sleeve may be fastened with the plate interposed between the tip end surface of the male screw of the compressor wheel and the root end surface of the female screw of the sleeve.

The male screw and the female screw may be right-handed screws when the compressor wheel rotates counter-clockwise and may be left-handed when the compressor wheel rotates clockwise as viewed from an inlet of the compressor wheel.

In this structure, a fitting hole or fitting opening for connecting the compressor wheel to the shaft is not required to be formed on the compressor wheel main body. Also, the concentricity between the compressor wheel and the shaft can be secured by the engagement portion formed therebetween. Accordingly, stress applied to the compressor wheel is decreased and the occurrence of breakage is reduced even if the compressor wheel is rotated at high speed. Furthermore, the structure in which the female screws are formed on the sleeve enlarges the screw size and thus increases the strength of the connection. In this specification, we use properly "hole" and "opening". "hole" means a through-hole". On the other hand, "opening" has a bottom.

DESCRIPTION OF THE PREFERRED EMBODIMENTS

Preferred embodiments of the invention will be hereinafter described in detail with reference to the accompanying drawings.

Figure 1:
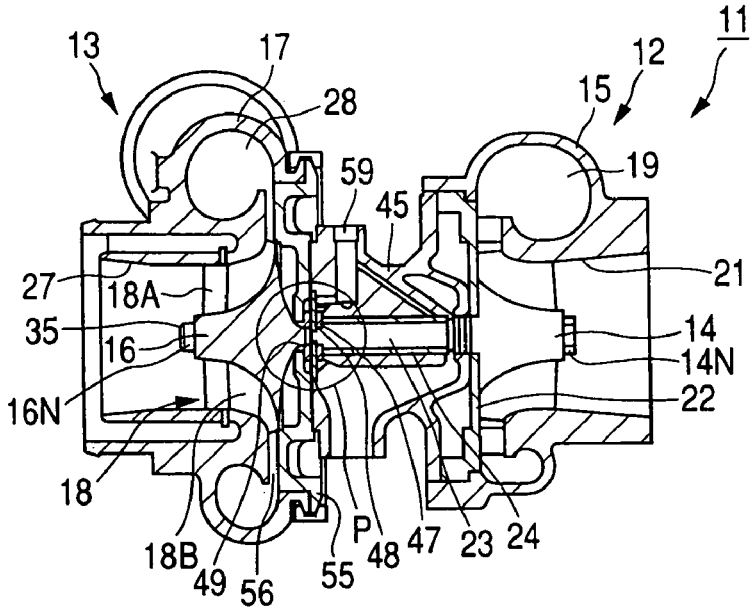
FIG. 1 is a cross-sectional view of a turbo charger in a first embodiment according to the invention.

Referring to FIG. 1, a turbo charger 11 includes an exhaust-side unit 12 for gaining rotational energy from exhaust gas of an engine, and an intake-side unit 13 for compressing air by the rotational energy and supplying the compressed air to the engine. The exhaust-side unit 12 of the turbo charger 11 has an exhaust-side housing 15 and a turbine wheel 14 which has a plurality of vanes and is supported by a shaft 23.

The exhaust-side housing 15 has an exhaust inflow passage 19 for supplying exhaust gas to the turbine wheel 14. The exhaust inflow passage 19 having an annular shape encompasses the outer diameter of the turbine wheel 14, and is connected to an engine exhaust flow passage through which the exhaust gas discharged from the engine (not shown) flows.

The exhaust-side housing 15 has an exhaust outflow port 21 for discharging the exhaust gas which has already released energy for the turbine wheel 14. The exhaust outflow port 21 is substantially cylindrical and concentric with the rotational center of the turbine wheel 14. An opening on the side opposite to the exhaust outflow port 21 is closed by an exhaust-side inner plate 22.

The shaft 23 is formed integrally with the turbine wheel 14. The shaft 23 penetrates through the exhaust-side inner plate 22 and is rotatably supported by a bearing 24. The turbine wheel 14 is generally made from a nickel-base super-alloy, while the shaft 23 is generally made from alloy steel or carbon steel.

A compressor wheel 16 is accommodated inside an intake-side housing 17. The intake-side housing 17 has an intake inflow port 27 for taking air into the compressor wheel 16. The intake inflow port 27 is substantially cylindrical and concentric with the rotational center of the compressor wheel 16. An opening on the side opposite to the intake inflow port 27 is closed by an intake-side inner plate 55.

Air having received velocity energy from the compressor wheel 16 is sent to a diffuser 56 where the velocity energy is converted into pressure energy. Then, the air passes through an intake exhaust passage 28 which is annular and encompasses the outer diameter of the compressor wheel 16, and is supplied to an air supply port of the engine (not shown).

The vanes 18 are constituted by full vanes 18A having a large width in an axial direction of the vane and intermediate vanes 18B whose vane inlet starts from an intermediate part of the full vanes 18A in the axial direction. The full vanes 18A and the intermediate vanes 18B are alternately disposed.

Figure 2:
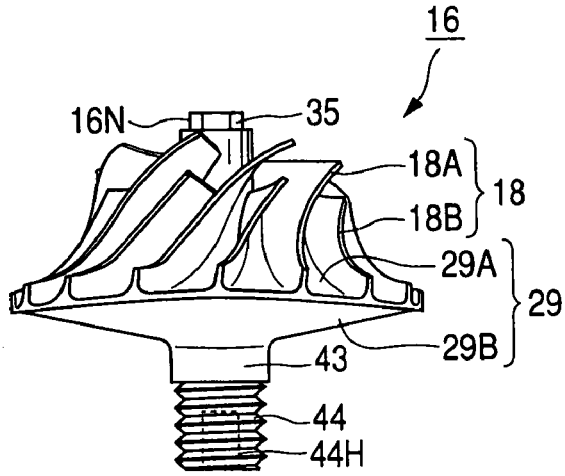
FIG. 2 is a side view of a compressor wheel in the first embodiment.
Figure 3:
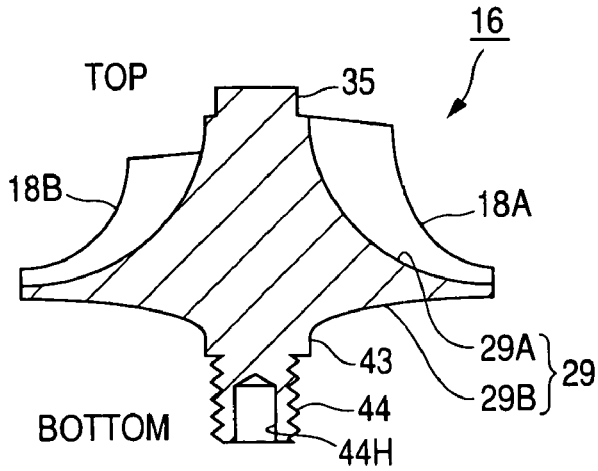
FIG. 3 is a cross-sectional view of FIG. 2.

As illustrated in FIGS. 2 and 3, a main body 29 of the compressor wheel 16 of the invention is solid and has no fitting hole or fitting opening.

A cylindrical portion 43 is formed integrally with the rearmost region of a rear-side disk portion 29B with its center aligned with that of the main body 29. A wheel male screw 44 having a smaller diameter than that of the cylindrical portion 43 is formed integrally with the cylindrical portion 43 at the lower end thereof. The wheel male screw 44 has an engagement opening 44H for securing the concentricity with the shaft 23.

A nut-shaped portion 16N is provided on the outer diameter of a wheel inlet 35 of the compressor wheel 16. The nut-shaped portion 16N has a clamping region to which clamping torque is applied. The clamping region may be nut-shaped or have two parallel surfaces, for example, which can be clamped by a spanner or the like.

Figure 4:
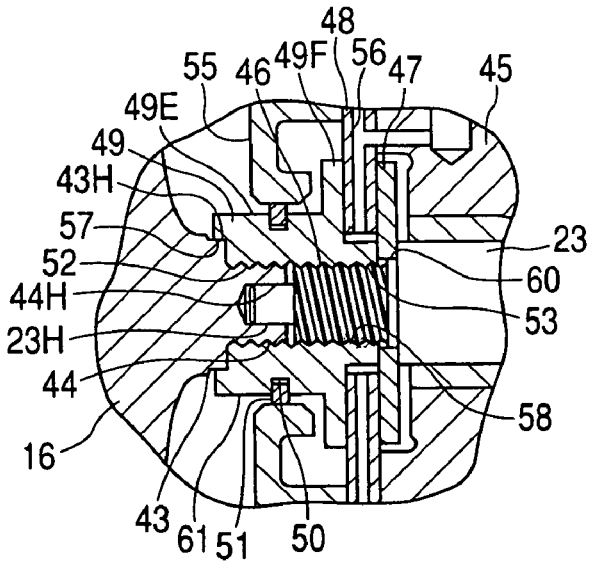
FIG. 4 illustrates a P area of FIG. 1 in detail.

FIG. 4 illustrates a P area of FIG. 1 in detail. A shaft cylindrical portion 60 which is cylindrical and concentric with the shaft 23 is provided on the tip of the shaft 23 fixed to the turbine wheel 14.

A shaft male screw 46 is further provided on the tip of the shaft cylindrical portion 60. As the shaft male screw 46 and the wheel male screw 44 have the same screw size, the outside diameters of those screws 44 and 46 are also the same. An engagement cylindrical portion 23H which is precisely machined to be cylindrical and concentric with the shaft 23 is provided at the tip of the shaft 23. The engagement cylindrical portion 23H is so sized as to be inserted into the engagement opening 44H of the wheel male screw 44 by slight clearance fit or close fit.

As illustrated in FIGS. 1 and 4, a flange 49F for receiving a thrust bearing 48 is provided on a cylindrical portion 49E of a sleeve 49, and a seal groove 50 is formed on the entire circumference of the middle part of the outer surface of the sleeve 49 in the axial direction of the rotational axis of the sleeve 49. A shaft-side female screw 53 engaging with the shaft male screw 46 is provided on an inner surface 58 of the sleeve 49 facing to the shaft 23, while a wheel-side female screw 52 engaging with the wheel male screw 44 is provided on the inner surface 58 of the sleeve 49 facing to the compressor wheel 16.

As the shaft male screw 46 and the wheel male screw 44 have the same screw size, the shaft-side female screw 53 and the wheel-side female screw 52 of the sleeve 49 also have the same size. Thus, the female screws provided on the inner surface of the sleeve 49 can be easily formed by a single process, and the accuracy of concentricity between the shaft-side female screw 53 and the wheel-side female screw 52 can be increased.

As illustrated in FIGS. 1 and 4, the shaft male screw 46 and the wheel male screw 44 are connected via the sleeve 49 having the female screws 52 and 53.

As illustrated in FIG. 4, the engagement cylindrical portion 23H of the shaft 23 is inserted into the engagement opening 44H of the compressor wheel 16 by slight clearance fit or close fit. The inner surface 58 of the sleeve 49 at an end facing to the compressor wheel 16 provides a spigot joint to be connected with the cylindrical portion 43 formed on the rear of the compressor wheel 16. A wheel engagement cylindrical portion 44H which is precisely machined to be cylindrical and concentric with the wheel male screw 44 is provided at the tip of the wheel male screw 44. A wheel engagement opening 57 is formed on the end inside diameter of the sleeve 49 facing to the compressor wheel 16. A wheel engagement cylindrical portion 43H is provided at the end of the cylindrical portion 43 of the wheel 16.

The wheel engagement cylindrical portion 43H is so sized as to be inserted into the wheel engagement opening 57 by slight clearance fit. Thus, the concentricity between the compressor wheel 16 and the shaft 23 can be secured.

An outer surface 61 of the cylindrical portion 49E of the sleeve 49 facing to the compressor wheel 16 is processed to have two parallel surfaces or to be nut-shaped (not shown) for example, so as to be clamped by a spanner or the like.

A seal ring 51 made from FC material or others is fitted to the seal groove 50 of the sleeve 49. When force is applied to the seal ring 51 in such a manner as to decrease the diameter of the seal ring 51, the outer diameter thereof is fitted to the inner surface of the intake-side inner plate 55 while tightly contacting therewith.

Figure 5:
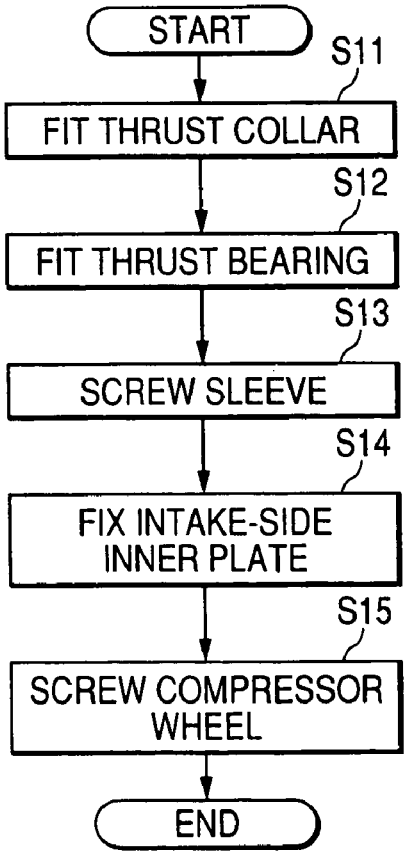
FIG. 5 is a flowchart showing processes for attaching the compressor wheel of the first embodiment.

FIG. 5 shows processes for attaching the compressor wheel 16 to the shaft 23.

First, a disk-shaped thrust collar 47 having a round hole at its center is fitted to the shaft 23 supported by the bearing 24 (Step S11).

Next, the thrust bearing 48 is fitted to a bearing housing 45 (Step S12). An oil passage 56 through which lubricant oil flows is formed on the thrust bearing 48. The lubricant oil lubricates the contact surfaces of the rotating sleeve 49 and the thrust collar 47 and the non-rotating thrust bearing 48.

The sleeve 49 is screwed to the shaft 23 (Step S13). In this step, the sleeve 49 is screwed to the shaft male screw 46 while clamping the outer diameter 61 of the sleeve 49 which is processed to be nut-shaped by a spanner or the like.

Then, the intake-side inner plate 55 is fixed to the bearing housing 45 (Step S14). Through this step, the thrust bearing 48 is sandwiched between the bearing housing 45 and the intake-side inner plate 55 as the non-rotating members and fixed therebetween, whereby the sleeve 49 and the thrust collar 47 come to rotate with the shaft 23 as one piece.

As a result, the thrust bearing 48 fixed to the non-rotating members in Step S13 is sandwiched between the thrust collar 47 and the sleeve 49 as the rotating members which rotate with the shaft 23 as one piece. Accordingly, force generated in the thrust direction of the shaft 23 during rotation is received by the thrust bearing 48, and the position of the rotational axis in the axial direction is thus restricted.

When the intake-side inner plate 55 is fixed to the bearing housing 45 in Step S14, the outer diameter of the seal ring 51 comes into tight contact with the inner surface of the intake-side inner plate 55. This structure prevents the oil for lubricating the bearing 24 and the thrust bearing 48 from flowing out toward a space at the back of the compressor wheel 16, i.e., a so-called "back chamber".

Next, the compressor wheel 16 is screwed into the sleeve 49 (Step S15). In this step, the nut-shaped portion 16N at the wheel inlet 35 of the compressor wheel 16 and the nut-shaped portion 14N of the turbine wheel 14 are clamped by a spanner or the like and screwed to each other as illustrated in FIG. 1. Simultaneously, the engagement cylindrical portion 23H of the shaft 23 is inserted into the engagement opening 44H of the compressor wheel 16 by slight clearance fit or close fit. Through this step, the compressor wheel 16 and the shaft 23 are connected with each other.

According to the invention as described above, the wheel male screw 44 is provided at the small diameter position of the compressor wheel 16. The wheel male screw 44 and the shaft male screw 46 formed at the tip of the shaft 23 are connected with each other via the sleeve 49 having the female screw 52 on one side and the female screw 53 on the other side.

Since the compressor wheel 16 and the shaft 23 are coupled with each other without the fitting hole 125 and the fitting opening 242 included in the related art, the compressor wheel 16 can be made solid. Thus, the stress applied to the compressor wheel 16 is decreased and the occurrence of the breakage is reduced even if rotated at high speed.

Figure 6:
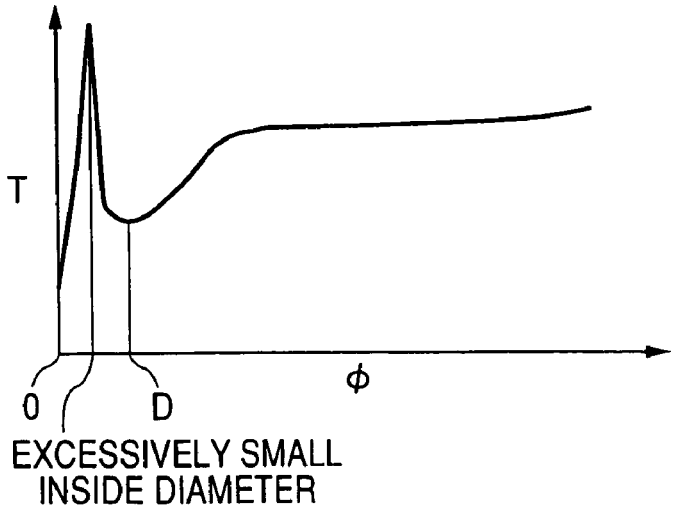
FIG. 6 PRIOR ART
FIG. 6 is a graph showing a general relationship between an inside diameter of a fitting hole and a magnitude of stress in the related art.

The reason for this effect is described with reference to FIG. 6. FIG. 6 is a graph showing the relationship between an inside diameter $\phi$ of the fitting hole of the compressor wheel and stress T applied to the compressor wheel in a maximum outer diameter where the outer diameter of the compressor wheel reaches a maximum in the axial direction of the rotational axis of the compressor wheel in the related art. As shown in FIG. 6, the stress T is small when the inside diameter of the fitting hole is zero, and the stress T is extremely large when the inside diameter is excessively small. When the inside diameter is a certain value D or larger, the stress T increases as the inside diameter of the fitting hole becomes larger.

Accordingly, unlike the related art, the stress applied is reduced in the invention where a solid component having no fitting hole is employed.

Next, a second embodiment is herein described. The second embodiment is different from the first embodiment in the structure of the P area. Similar reference numerals are given to similar components to those in the first embodiment, and description associated therewith is omitted.

Figure 7:
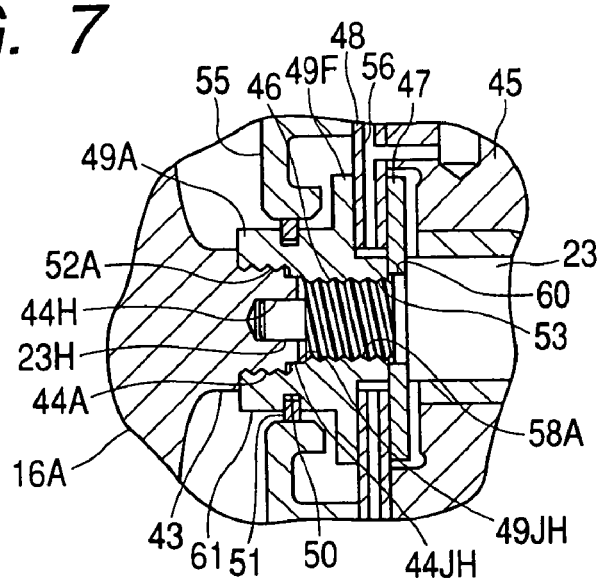
FIG. 7 illustrates a second embodiment according to the invention in detail.

As illustrated in FIG. 7, the screw size of a wheel male screw 44A is larger than that of the shaft male screw 46. A wheel engagement cylindrical portion 44JH which is precisely machined to be cylindrical and concentric with the wheel male screw 44A is provided at the tip of the wheel male screw 44A. A sleeve engagement opening 49JH is formed between the shaft-side female screw 53 and a wheel-side female screw 52A of a sleeve 49A. The wheel engagement cylindrical portion 44JH is so sized as to be inserted into the wheel engagement opening 49JH of the sleeve 49A by slight clearance fit.

The shaft-side female screw 53 engaging with the shaft male screw 46 is formed on an inner surface 58A of the sleeve 49A facing to the shaft 23. The wheel-side female screw 52A engaging with the wheel male screw 44A is formed on the inner surface 58A of the sleeve 49A facing to a compressor wheel 16A. The screw size of the wheel male screw 44A is larger than that of the shaft male screw 46.

The shaft male screw 46 and the wheel male screw 44A are connected with each other via the sleeve 49A having the wheel-side female screw 52A and the shaft-side female screw 53.

The engagement cylindrical portion 23H of the shaft 23 is inserted into the engagement opening 44H of the compressor wheel 16A by slight clearance fit or close fit. The wheel engagement cylindrical portion 44JH is inserted into the wheel engagement opening 49JH of the sleeve 49A by slight clearance fit. Thus, the concentricity between the compressor wheel 16A and the shaft 23 can be sufficiently secured. The wheel engagement cylindrical portion 44JH may be provided at the tip outer surface of the wheel male screw 44A, or at the root end outer surface of the wheel male screw 44A.

The compressor wheel 16A and the wheel male screw 44A are made from an aluminum alloy casting or other material, while the shaft 23 and the shaft male screw 46 are made from hard material such as iron or iron alloy. The diameter of the wheel male screw 44A formed integrally with the compressor wheel 16A is larger than the diameter of the shaft male screw 46 formed at the tip of the shaft 23. Since the diameter of the aluminum alloy casting having lower strength is larger, the possibility that either the compressor wheel or the shaft is particularly easy to break is reduced.

Next, a third embodiment is herein described. The third embodiment is different from the first embodiment also in the structure in the P area. Similar reference numerals are given to similar components to those in the first embodiment, and description associated therewith is omitted.

Figure 8A:
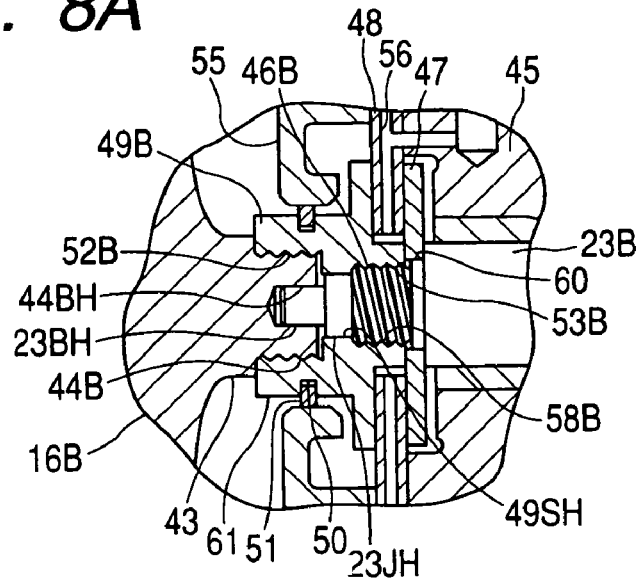
FIGS. 8A and 8B each illustrate a third embodiment according to the invention in detail.

As illustrated in FIG. 8A, the shaft cylindrical portion 60 which is processed to be cylindrical and concentric with a shaft 23B is provided at the tip of the shaft 23B.

A shaft male screw 46B is formed at a position closer to the tip from the shaft cylindrical portion 60. The screw size of a wheel male screw 44B is larger than that of the shaft male screw 46B, and thus the outside diameter of the wheel male screw 44B is larger than that of the shaft male screw 46B. A shaft engagement cylindrical portion 23JH which is precisely machined to be cylindrical and concentric with the shaft 23B is provided at a position closer to the tip from the shaft male screw 46B.

A shaft engagement opening 49SH is formed between a shaft-side female screw 53B and a wheel-side female screw 52B of a sleeve 49B. The shaft engagement cylindrical portion 23JH is so sized as to be inserted into the shaft engagement opening 49SH of the sleeve 49B by slight clearance fit. An engagement cylindrical portion 23BH which is precisely machined to be cylindrical and concentric with the shaft 23B is provided at the tip of the shaft 23B. The cylindrical portion 23BH is so sized as to be inserted into an engagement opening 44BH of the wheel male screw 44B by slight clearance fit or close fit.

Figure 8B:
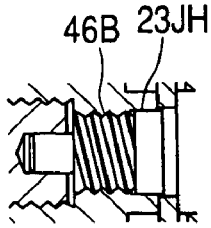

The shaft engagement cylindrical portion 23JH may be provided at the tip outer surface of the shaft male screw 46B, or at the root end of the shaft male screw 46B as illustrated in FIG. 8B.

As illustrated in FIG. 8A, a shaft-side female screw 53B engaging with the shaft male screw 46B is provided on an inner surface 58B of the sleeve 49B facing to the shaft 23B, while a wheel-side female screw 52B engaging with the wheel male screw 44B on the inner surface 58B of the sleeve 49B facing to the compressor wheel 16B. Since the screw size of the wheel male screw 44B is larger than that of the shaft male screw 46B, the screw size of the wheel-side female screw 52B is larger than that of the shaft-side female screw 53B.

The shaft male screw 46B and the wheel male screw 44B are connected with each other via the sleeve 49B having the wheel-side female screw 52B and the shaft-side female screw 53B.

The engagement cylindrical portion 23BH of the shaft 23B is inserted into the engagement opening 44BH of the compressor wheel 16B by slight clearance fit or close fit. The shaft engagement cylindrical portion 23JH is inserted into the shaft engagement opening 49SH of the sleeve 49B by slight clearance fit. Thus, the concentricity between the compressor wheel 16B and the shaft 23B can be sufficiently secured.

Next, a fourth embodiment is herein described. The fourth embodiment is an example in which the engagement part between the sleeve and the wheel in the second embodiment is added to the third embodiment. Similar reference numerals are given to similar components to those in the second and third embodiments, and description associated therewith is omitted.

Figure 9:
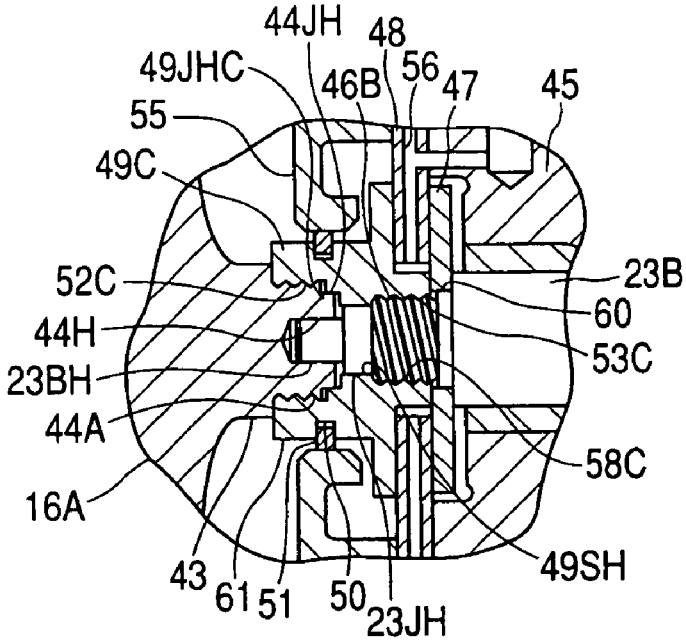
FIG. 9 illustrates a fourth embodiment according to the invention in detail.

As illustrated in FIG. 9, the shaft 23B includes the shaft cylindrical portion 60, the shaft male screw 46B, and the shaft engagement cylindrical portion 23JH. A sleeve 49C has the shaft engagement opening 49SH. The shaft engagement cylindrical portion 23JH is so sized as to be inserted into the shaft engagement opening 49SH of the sleeve 49C by slight clearance fit. The engagement cylindrical portion 23BH is provided at the tip of the shaft 23B. The engagement cylindrical portion 23BH is so sized as to be inserted into the engagement opening 44H of the wheel male screw 44A by slight clearance fit or close fit.

The wheel engagement cylindrical portion 44JH which is precisely machined to be cylindrical and concentric with the wheel male screw 44A is provided at the tip of the wheel male screw 44A. A sleeve engagement opening 49JHC is formed between a shaft-side female screw 53C and a wheel-side female screw 52C of the sleeve 49C. The wheel engagement cylindrical portion 44JH is so sized as to be inserted into the wheel engagement opening 49JHC of the sleeve 49C by slight clearance fit.

The shaft-side female screw 53C engaging with the shaft male screw 46B is provided on an inner surface 58C of the sleeve 49C facing to the shaft 23B, while the wheel-side female screw 52C engaging with the wheel-side male screw 44A is provided on the inner surface 58C of the sleeve 49C facing to the compressor wheel 16A.

The shaft male screw 46B and the wheel male screw 44A are connected with each other via the sleeve 49C having the wheel-side female screw 52C and the shaft-side female screw 53C.

The engagement cylindrical portion 23BH of the shaft 23B is inserted into the engagement opening 44H of the compressor wheel 16A by slight clearance fit or close fit. The shaft engagement cylindrical portion 23JH is inserted into the shaft engagement opening 49SH of the sleeve 49C by slight clearance fit. The wheel engagement cylindrical portion 44JH is inserted into the wheel engagement opening 49JHC of the sleeve 49C by slight clearance fit. Thus, the concentricity between the compressor wheel 16A and the shaft 23B can be sufficiently secured.

Next, a fifth embodiment is herein described. The fifth embodiment is a different example in which a plate 70 is added to the third embodiment.

Figure 10:
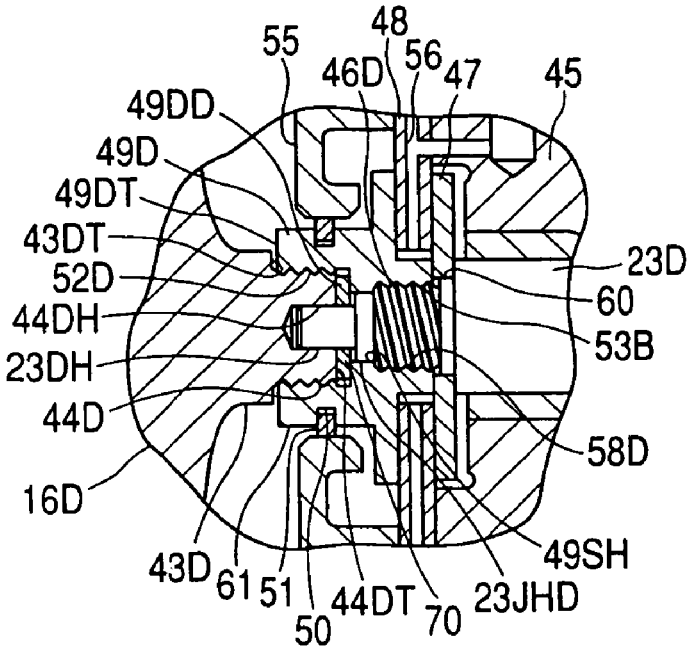
FIG. 10 illustrates a fifth embodiment according to the invention in detail.
Figure 11:
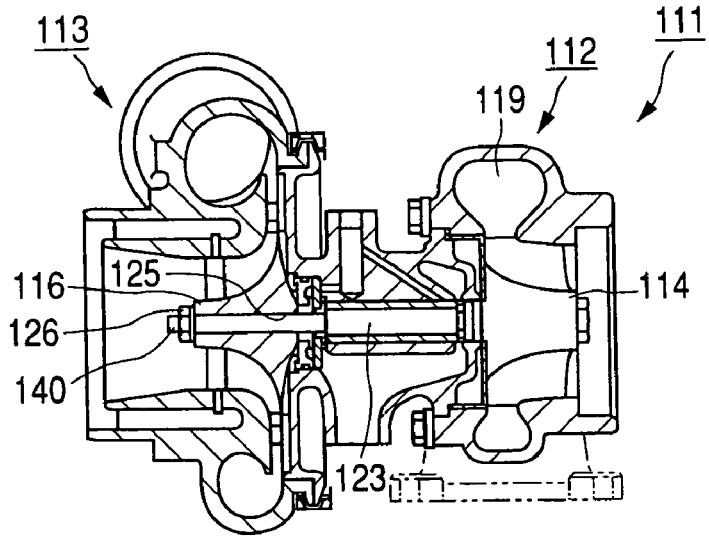
FIG. 11 PRIOR ART
FIG. 11 is a sectional side view of a prevailing type of a turbo charger in the related art.
Figure 12:
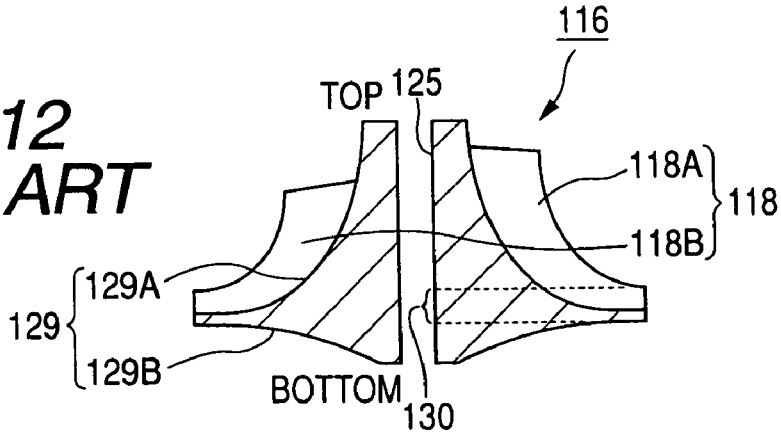
FIG. 12 PRIOR ART
FIG. 12 is a sectional side view of a prevailing type of a compressor wheel in the related art.
Figure 13:
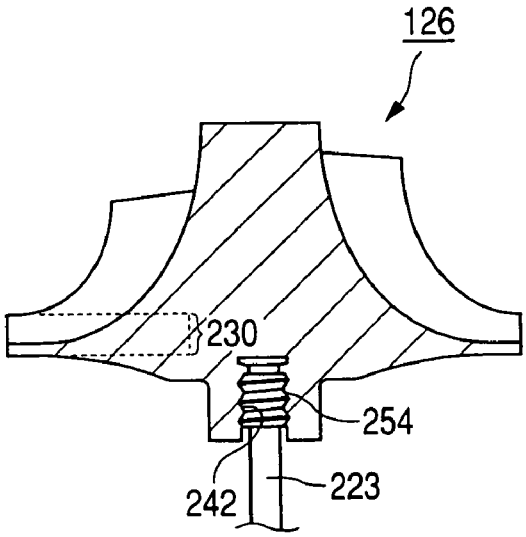
FIG. 13 PRIOR ART
FIG. 13 is a cross-sectional view of a prevailing type of a compressor wheel in the related art.

As illustrated in FIG. 10, a shaft 23D includes the shaft cylindrical portion 60, a shaft male screw 46D, and a shaft engagement cylindrical portion 23JHD. A sleeve 49D has a shaft engagement opening 49SHD. An engagement cylindrical portion 23DH is provided at the tip of the shaft 23D and is so sized as to be inserted into an engagement opening 44DH of a wheel male screw 44D by slight clearance fit or close fit. The sleeve 49D has a shaft-side female screw 53D and a wheel-side female screw 52D.

An end surface 43DT of a cylindrical portion 43D of a compressor wheel 16D and an end surface 49DT of the sleeve 49D are so sized as to have a clearance between each other when the compressor wheel 16D and the shaft 23D are tightened. An end surface 44DT of the wheel male screw 44D and a stepped portion 49DD of the sleeve 49D are tightened with a washer-shaped plate 70 interposed therebetween. The plate 70 is made from a material harder than the material of the compressor wheel 16D. Since the end surface of the compressor wheel 16D which is pressed when fastening torque is applied for the attachment of the compressor wheel 16D has a wide area, the surface pressure can be decreased.

According to the invention, the shafts 23, 23B and 23D have the shaft male screws 46, 46B and 46D to which the sleeves 49, 49A, 49B, 49C and 49D having the female screws 52, 52A, 52B, 52C, 52D, 53, 53B, 53C and 53D are screwed. This structure allows the screw diameter of the wheel-side female screw 52D to be larger than that of an example where a female screw is provided on a shaft, thereby increasing the fastening strength.

Since the seal groove 50 is formed on the outer surface of the sleeves 49, 49A, 49B, 49C and 49D, oil can be sealed by a compact structure.

The male screws 44, 44A, 44B and 44D of the compressor wheels 16, 16A, 16B and 16D, the shaft male screws 46, 46B, 46D, and the female screws 52, 52A, 52B, 52C, 52D, 53, 53B, 53C and 53D of the sleeves 49, 49A, 49B, 49C and 49D are right-handed screws when the compressor wheels 16, 16A, 16B and 16D rotate counterclockwise and are left-handed screws when the compressor wheels 16, 16A, 16B and 16D rotate clockwise as viewed from the intake inflow port 27 as the inlet of the compressor wheels 16, 16A, 16B and 16D. Since the rotational torque produced due to inertial force generated when the compressor wheels 16, 16A, 16B and 16D are rapidly accelerated for rotation is applied in a direction where the screws are tightened, loosening of the screws is prevented.

While only an example of a turbo charger to which the invention is applied has been described, the invention is applicable to other turbo machines such as micro gas turbines and engine-driven superchargers.

What is claimed is:

1. A connecting structure comprising a compressor wheel, a shaft and a sleeve, wherein:

the compressor wheel has a male screw formed on an outer surface of a projection provided at the center of a rear surface of the compressor wheel;

the shaft has a male screw provided at one end thereof;

the sleeve has female screws provided at each end thereof and connects the compressor wheel and the shaft; and an engagement portion is provided between the compressor wheel and the shaft.

2. The connecting structure as set forth in claim 1, wherein an engagement portion is provided between the compressor wheel and the sleeve.

3. The connecting structure as set forth claim 2, wherein:

a plate made from material having higher strength than a material of the compressor wheel is further provided; and the compressor wheel and the sleeve are fastened with the plate interposed between the tip end surface of the male screw of the compressor wheel and the root end surface of the female screw of the sleeve.

4. The connecting structure as set forth in claim 2, wherein the male screws and the female screws are right-handed screws when the compressor wheel rotates counterclockwise and are left-handed when the compressor wheel rotates clockwise as viewed from an inlet of the compressor wheel.

5. The connecting structure as set forth in claim 1, wherein an engagement portion is provided between the shaft and the sleeve.

6. The connecting structure as set forth claim 5, wherein:

a plate made from material having higher strength than a material of the compressor wheel is further provided; and the compressor wheel and the sleeve are fastened with the plate interposed between the tip end surface of the male screw of the compressor wheel and the root end surface of the female screw of the sleeve.

7. The connecting structure as set forth in claim 5, wherein the male screws and the female screws are right-handed screws when the compressor wheel rotates counterclockwise and are left-handed when the compressor wheel rotates clockwise as viewed from an inlet of the compressor wheel.

8. The connecting structure as set forth in claim 1, wherein an engagement portion engaging with the sleeve is provided on each of the compressor wheel and the shaft.

9. The connecting structure as set forth claim 1, wherein:

a plate made from material having higher strength than a material of the compressor wheel is further provided; and the compressor wheel and the sleeve are fastened with the plate interposed between the tip end surface of the male screw of the compressor wheel and the root end surface of the female screw of the sleeve.

10. The connecting structure as set forth in claim 1, wherein the male screws and the female screws are right-handed screws when the compressor wheel rotates counterclockwise and are left-handed when the compressor wheel rotates clockwise as viewed from an inlet of the compressor wheel.

* * * * *